US008701324B1

(12) United States Patent
Viani

(10) Patent No.: US 8,701,324 B1
(45) Date of Patent: Apr. 22, 2014

(54) FORWARD FACING THUMB TAB FOR FIREARMS

(76) Inventor: Arthur J. Viani, Miami, FL (US)

( * ) Notice: Subject to any disclaimer, the term of this patent is extended or adjusted under 35 U.S.C. 154(b) by 16 days.

(21) Appl. No.: 13/282,067

(22) Filed: Oct. 26, 2011

(51) Int. Cl.
*F41A 3/00* (2006.01)
*F41C 7/00* (2006.01)

(52) U.S. Cl.
USPC ..... 42/16

(58) Field of Classification Search
USPC ..... 42/16
See application file for complete search history.

(56) References Cited

U.S. PATENT DOCUMENTS 1,333,572 A * 3/1920 Pedersen ..... 89/138
1,801,072 A * 4/1931 Browning ..... 89/138
2,320,450 A * 6/1943 Valenzuela ..... 42/106
3,207,037 A * 9/1965 Pachmayr et al. ..... 89/196
4,742,634 A * 5/1988 Swenson ..... 42/70.01
4,777,754 A * 10/1988 Reynolds, Jr. ..... 42/117
6,415,702 B1 * 7/2002 Szabo et al. ..... 89/148
2002/0194762 A1 * 12/2002 Cominolli ..... 42/70.06
2011/0126441 A1 * 6/2011 Vukovic ..... 42/70.02

* cited by examiner

*Primary Examiner* — Samir Abdosh
(74) *Attorney, Agent, or Firm* — Albert Bordas, P.A.

(57) ABSTRACT

A firearm slide stop having a forward facing thumb tab mounted within a semi-automatic handgun. The firearm slide stop having a forward facing thumb tab functions to give a visual indication when the firearm has expended all loaded ammunition. Firearm slide stop having a forward facing thumb tab also functions and facilitates faster re-loading by removing the step of pulling back the slide of firearm to advance the first round of a new magazine by replacing the magazine and activating a push-button or lever release to load the first cartridge into the chamber. The firearm slide stop having a forward facing thumb tab functions while accommodating a user utilizing variable firearm gripping techniques. Specifically, the user using current recoil control gripping techniques, may grasp firearm without interfering with the functionality of the slide stop and specifically the thumb tab.

5 Claims, 7 Drawing Sheets

FORWARD FACING THUMB TAB FOR FIREARMS

BACKGROUND OF THE INVENTION

1. Field of the Invention

The present invention relates to firearm accessories, and more specifically, to a firearm slide stop having a forward facing thumb tab.

2. Description of the Related Art

A slide stop, also referred to as a slide release on firearms such as a semi-automatic handgun, is a part that functions to give visual indication when a firearm has expended all loaded ammunition and facilitates faster re-loading by removing the step of pulling back the slide to advance the first round of a new magazine. In many cases, this is achieved by replacing the magazine and activating a push-button or lever release to load the first cartridge into the chamber.

However, in most cases due to variable firearm gripping techniques, the slide stop fails to function. Specifically, recoil control requires placement of thumbs over existing slide stops. Therefore, failing to visually indicate when the firearm has expended all loaded ammunition when in fact it has.

SUMMARY OF THE INVENTION

The instant invention is a firearm slide stop having a forward facing thumb tab, comprising a slide stop thumb tab frame section having a slide engagement edge and a first forward edge. The slide stop thumb tab frame section further comprises a thumb tab a first predetermined distance from the slide engagement edge. The slide stop thumb tab frame section further comprises first interior and exterior faces and top and bottom faces. The top and bottom faces extend between the slide engagement edge and the first forward edge. The top face extends to a slide engagement exterior wall having a slide engagement bottom edge. The instant invention also comprises a slide stop intermediate frame section and a slide stop forward frame section. The thumb tab extends a second predetermined distance towards the slide stop forward frame section. A spring is mounted onto the slide stop intermediate frame section.

The thumb tab extends a third predetermined distance beyond the first forward edge towards the slide stop forward frame section without reaching the slide stop forward frame section. The thumb tab comprises a thumb tab exterior face and a thumb tab interior face, top and bottom edges, a second forward edge, and a rear edge. A first distance between the top and bottom edges is lesser than a second distance between the forward and rear edges. The second predetermined distance is greater than the third predetermined distance. The slide stop intermediate frame section further comprises second interior and exterior faces, and a magazine follower actuator having a top wall with an end. The slide stop intermediate frame section further comprises a spring clamp. The slide stop forward frame section comprises second interior and exterior faces and a through hole. The spring comprises a body having first and second ends.

It is therefore one of the main objects of the present invention to provide a firearm slide stop having a forward facing thumb tab that functions to give visual indication when a firearm has expended all loaded ammunition.

It is another object of the present invention to provide the firearm slide stop having a forward facing thumb tab that facilitates faster re-loading by removing the step of pulling back the slide to advance the first round of a new magazine.

It is another object of the present invention to provide the firearm slide stop having a forward facing thumb tab that does not interfere with the function of the firearm while a user utilizes various gripping techniques.

It is another object of this invention to provide a firearm slide stop having a forward facing thumb tab that is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
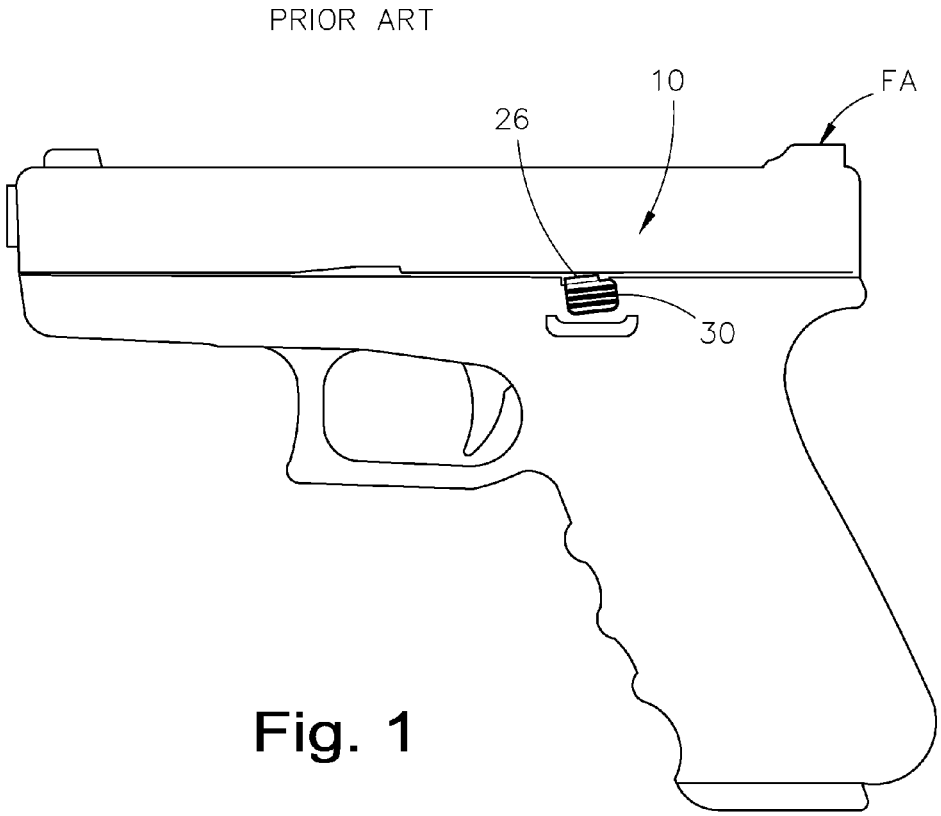
FIG. 1 is a front elevational view of a prior art slide stop mounted within a firearm.

Referring now to the drawings, the present invention is a firearm slide stop having a forward facing thumb tab and is generally referred to with numeral 110. It can be observed in FIGS. 7 through 13 that it basically includes slide stop thumb tab frame section 120, slide stop intermediate frame section 160, spring 180, slide stop forward frame section 190, and thumb tab 200.

Seen in FIG. 1 is prior art slide stop 10, also referred to as a slide release. Prior art slide stop 10 is mounted within a semi-automatic handgun, firearm FA, and is intended to function and give a visual indication when firearm FA has expended all loaded ammunition. Prior art slide stop 10 also is intended to function and facilitate faster re-loading by removing the step of pulling back the slide of firearm FA to advance the first round of a new magazine. In many cases, this is achieved by replacing the magazine and activating a push-button or lever release to load the first cartridge into the chamber.

Figure 2:
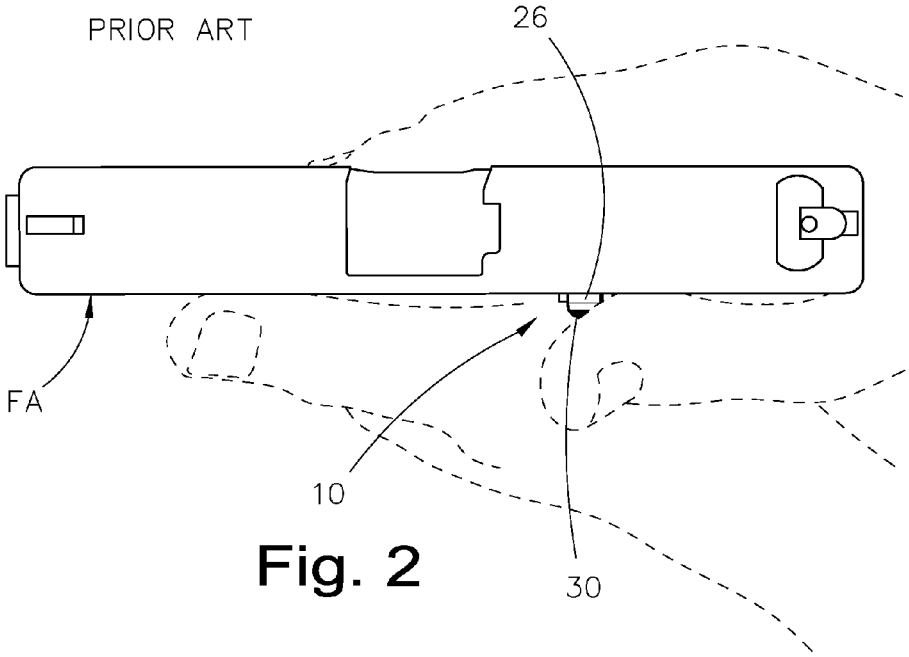
FIG. 2 is a top elevational view of a user gripping the firearm having the prior art slide stop.
Figure 3:
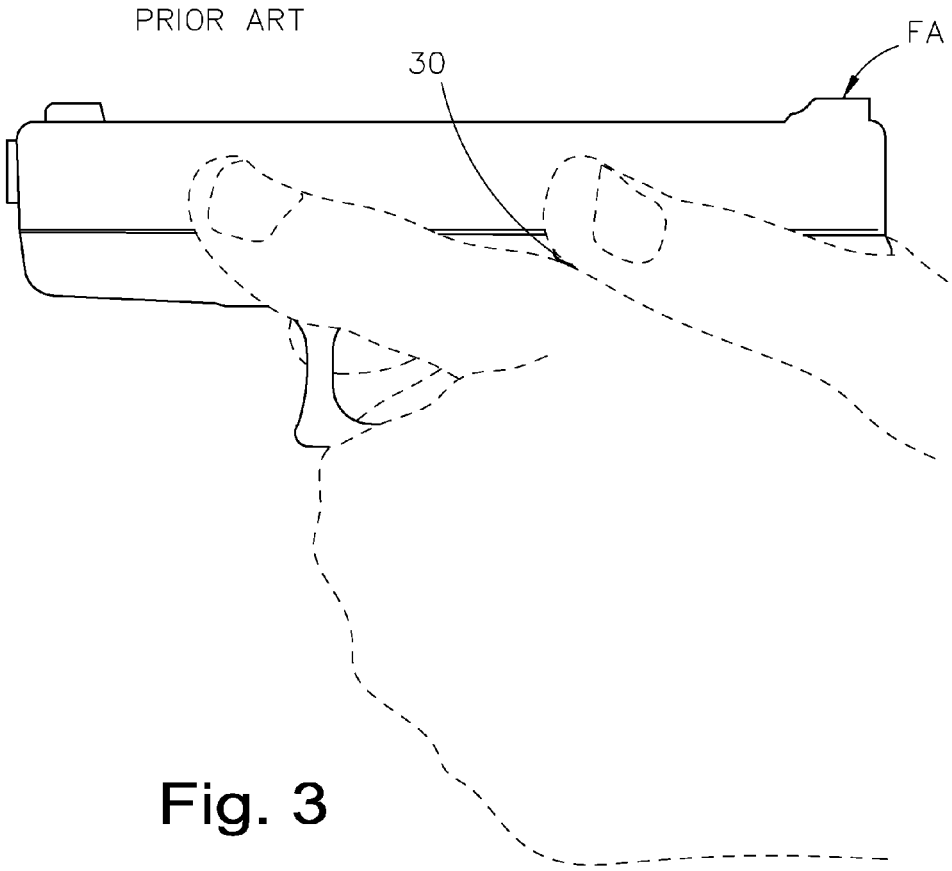
FIG. 3 is a front elevational view of the user gripping the firearm and covering the prior art slide stop.

However, as seen in FIGS. 2 and 3, in most cases due to variable firearm gripping techniques, prior art slide stop 10 fails to function. Specifically, recoil control requires placement of a user's thumbs over prior art slide stop 10. Therefore, failing to visually indicate when firearm FA has expended all loaded ammunition when in fact it has. This occurs because prior art slide stop 10 is unintentionally kept in a closed position and the user holding firearm FA falsely believes the magazine still has cartridges therein, when it is already empty. On the contrary, if the user's thumbs are positioned below prior art slide stop 10, they will cause prior art slide stop 10 to open inadvertently while cartridges remain in the magazine. Therefore, falsely visually indicating that firearm FA has expended all loaded ammunition when in fact it has not.

Figure 4:
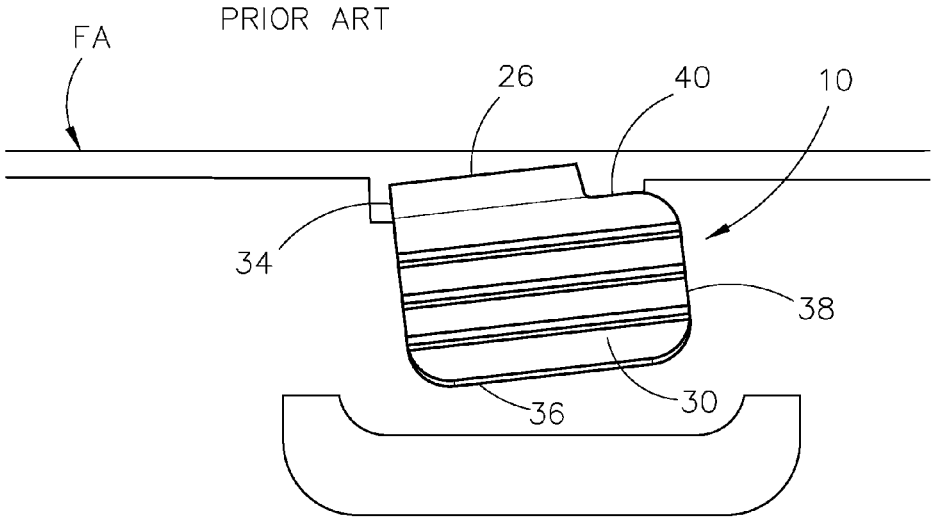
FIG. 4 is an enlarged view of the prior art slide stop mounted within the firearm.
Figure 5:
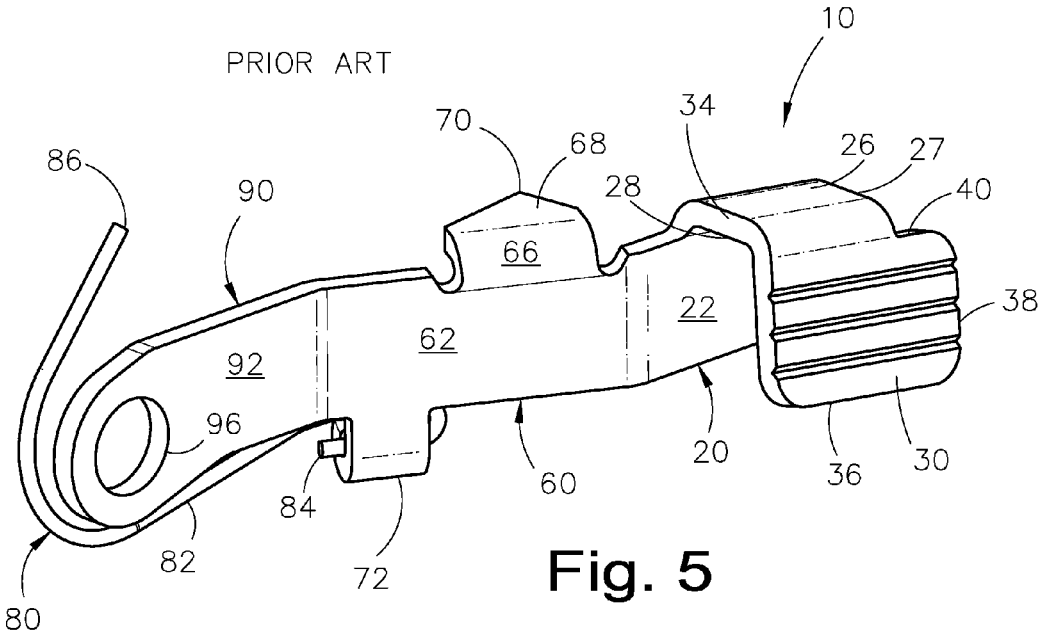
FIG. 5 is a first isometric view of the prior art slide stop.
Figure 6:
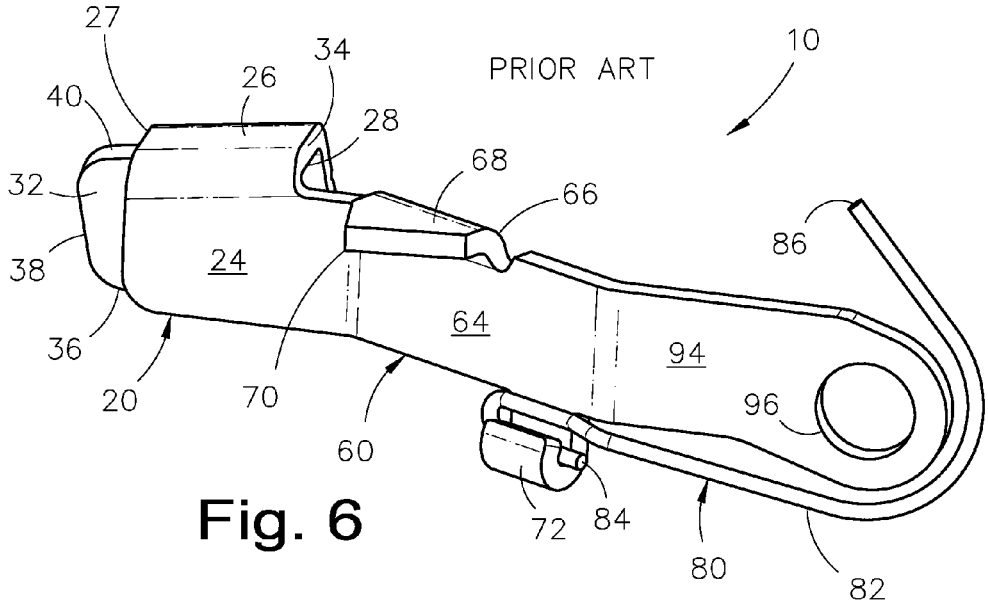
FIG. 6 is a second isometric view of the prior art slide stop.

As seen in FIGS. 4, 5, and 6, prior art slide stop 10 comprises slide stop thumb tab frame section 20, slide stop intermediate frame section 60, spring 80, and slide stop forward frame section 90.

Slide stop thumb tab frame section 20 comprises exterior face 22, interior face 24, top face 26, slide engagement edge 27, bottom face 28, thumb tab exterior face 30, thumb tab interior face 32, forward edge 34, bottom edge 36, rear edge 38 and top edge 40. Slide stop intermediate frame section 60 comprises exterior face 62, interior face 64, magazine follower actuator 66, top wall 68, end 70 and spring clamp 72. Spring 80 comprises body 82, end 84 and end 86. Slide stop forward frame section 90 comprising exterior face 92, interior face 94 and hole 96.

Figure 7:
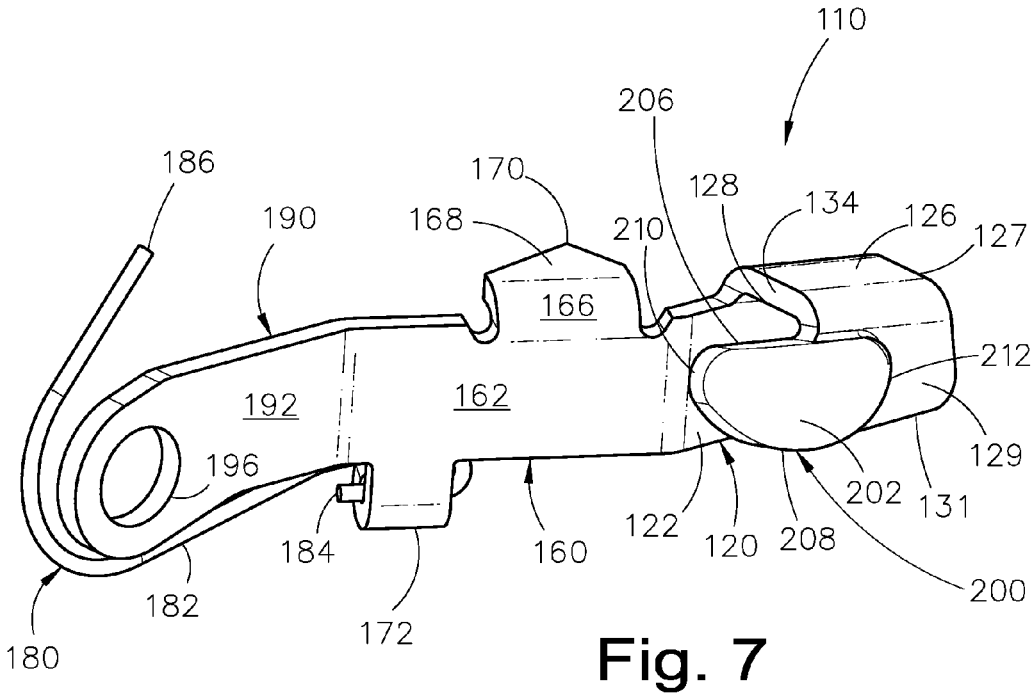
FIG. 7 is a first isometric view of the instant invention.
Figure 8:
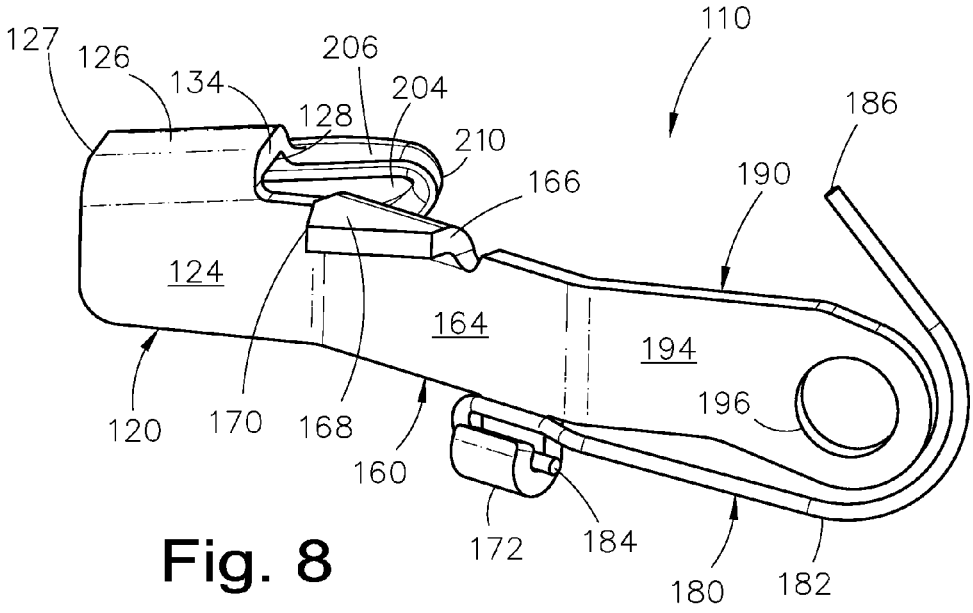
FIG. 8 is a second isometric view of the instant invention.

As seen in FIGS. 7 and 8, forward facing thumb tab for firearms 110 comprises includes slide stop thumb top frame section 120, slide stop intermediate frame section 160, spring 180, slide stop forward frame section 190, and thumb tab 200.

Slide stop thumb tab frame section 120 comprises slide engagement edge 127 and first forward edge 134. Slide stop thumb tab frame section 120 also comprises first interior and exterior faces 124 and 122 respectively, and top and bottom faces 126 and 128 respectively. Top and bottom faces 126 and 128 extend between slide engagement edge 127 and first forward edge 134. Top face 126 also extends to slide engagement exterior wall 129, which has slide engagement bottom edge 131.

Slide stop thumb tab frame section 120 further comprises thumb tab 200 at a first predetermined distance from slide engagement edge 127. Thumb tab 200 comprises thumb tab exterior face 202, thumb tab interior face 204, top edge 206, bottom edge 208, forward edge 210 and rear edge 212. The distance between top edge 206 and bottom edge 208 is lesser than the distance between forward edge 210 and rear edge 212. Thumb tab 200 extends a second predetermined distance towards slide stop forward frame section 190. Also, thumb tab 200 extends a third predetermined distance beyond first forward edge 134 towards slide stop forward frame section 190 without reaching slide stop forward frame section 190. It is noted that the second predetermined distance is greater than the third predetermined distance.

Slide stop intermediate frame section 160 comprises exterior and interior faces 162 and 164 respectively, and magazine follower actuator 166. Magazine follower actuator 166 has top wall 168 with end 170. Slide stop intermediate frame section 160 further comprises spring clamp 172.

Spring 180 has body 182 and ends 184 and 186. Spring 180 is mounted onto slide stop intermediate frame section 160. Specifically, a section of spring 180 adjacent to end 184 is secured within spring clamp 172.

Slide stop forward frame section 190 comprises exterior face 192 and interior face 194. Hole 196 extends from exterior face 192 to interior face 194.

Figure 9:
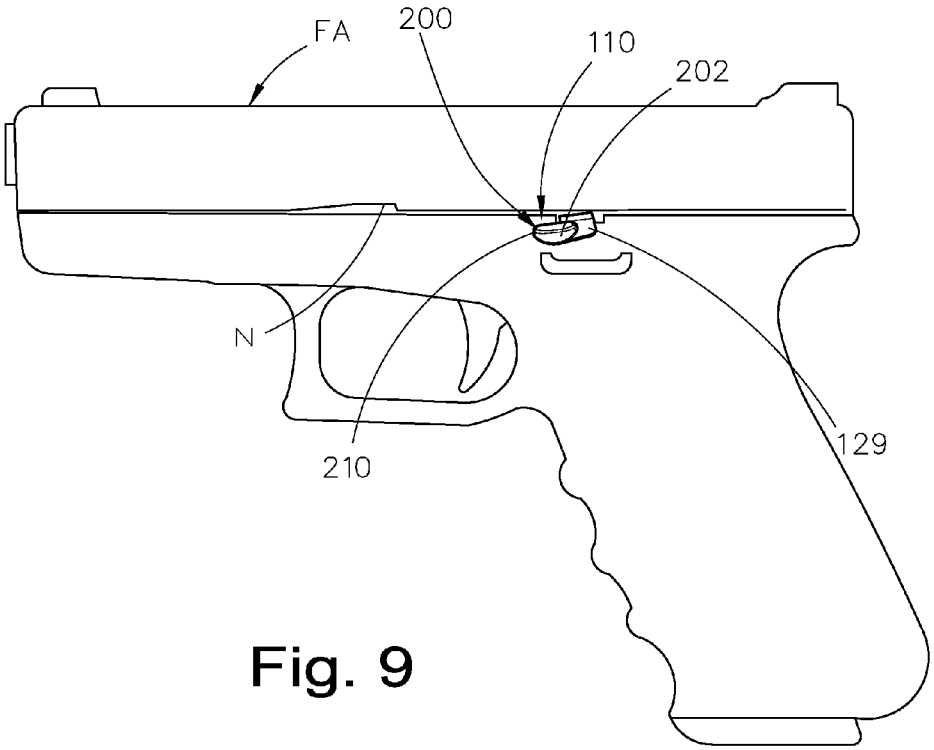
FIG. 9 is a front elevational view of the instant invention mounted within a firearm.

Seen in FIG. 9 is firearm slide stop having a forward facing thumb tab 110 mounted within the semi-automatic handgun, firearm FA. Instant invention 110 functions to give a visual indication when firearm FA has expended all loaded ammunition. Instant invention 110 also functions and facilitates faster re-loading by removing the step of pulling back the slide of firearm FA to advance the first round of a new magazine when replacing the magazine and activating a push-button or lever release to load the first cartridge into the chamber. Notch N of firearm FA functions to catch slide engagement edge 127 instant invention 110 when firearm FA has expended all loaded ammunition.

Figure 10:
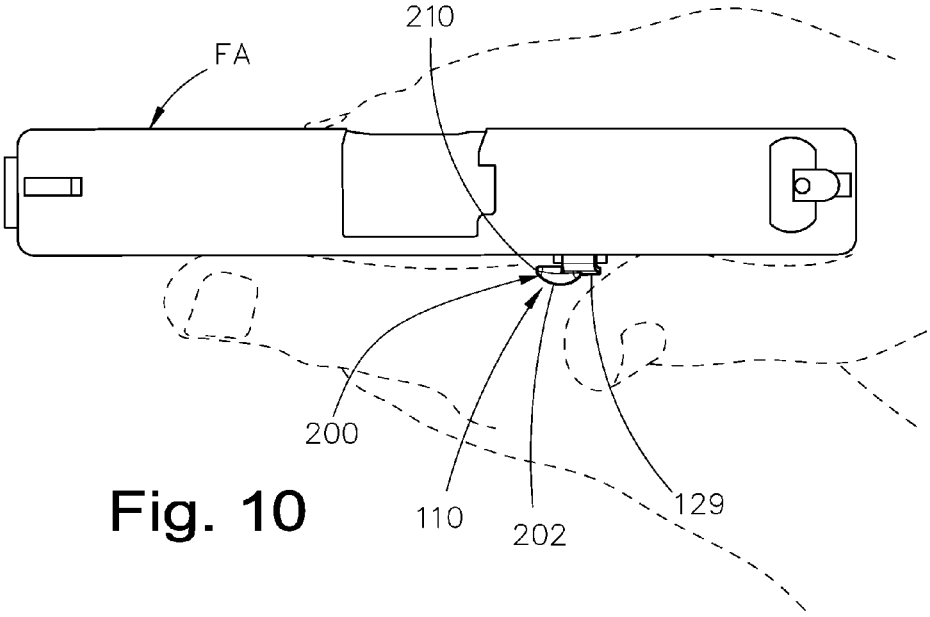
FIG. 10 is a top elevational view of a user gripping the firearm having the present invention.
Figure 11:
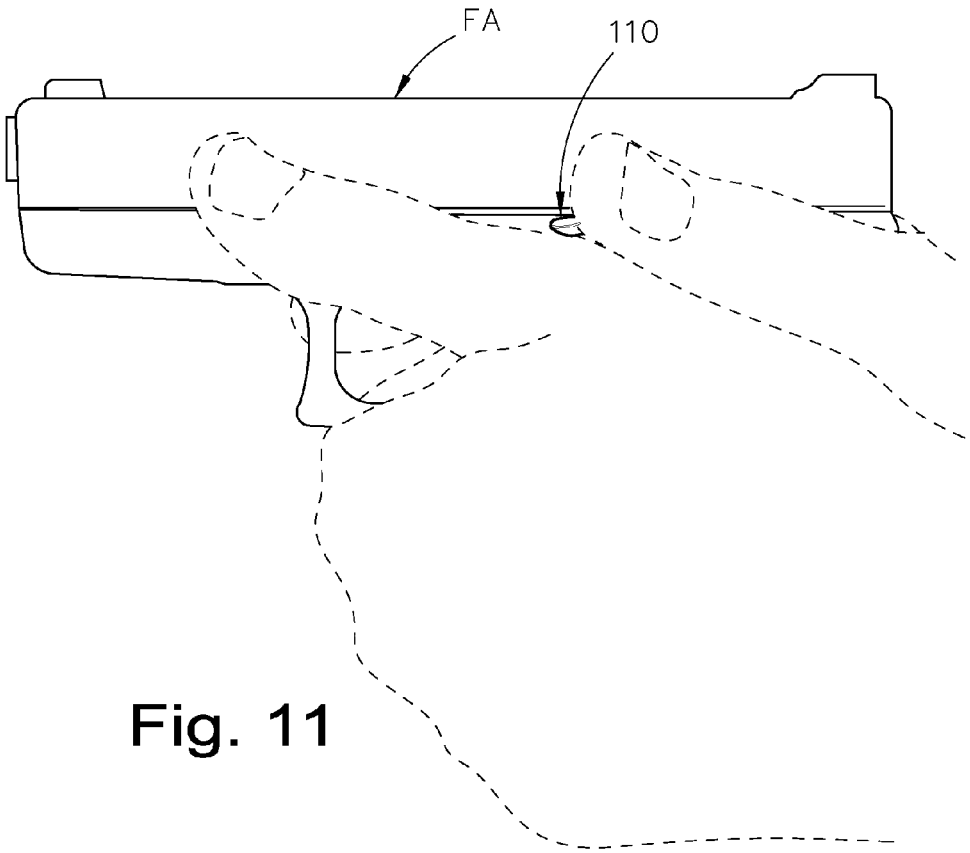
FIG. 11 is a front elevational view of the user gripping the firearm having the present invention.

As seen in FIGS. 10 and 11, instant invention 110 functions while accommodating a user utilizing variable firearm gripping techniques. Specifically, the user using current recoil control gripping techniques, may grasp firearm FA without interfering with the functionality of instant invention 110, and specifically thumb tab 200. In operation, a section of slide engagement exterior wall 129 may be covered by the user's thumb, but thumb tab 200 will remain unobstructed. Instant invention 110 therefore correctly gives visual indication when firearm FA has expended all loaded ammunition when in fact it has.

Figure 12:
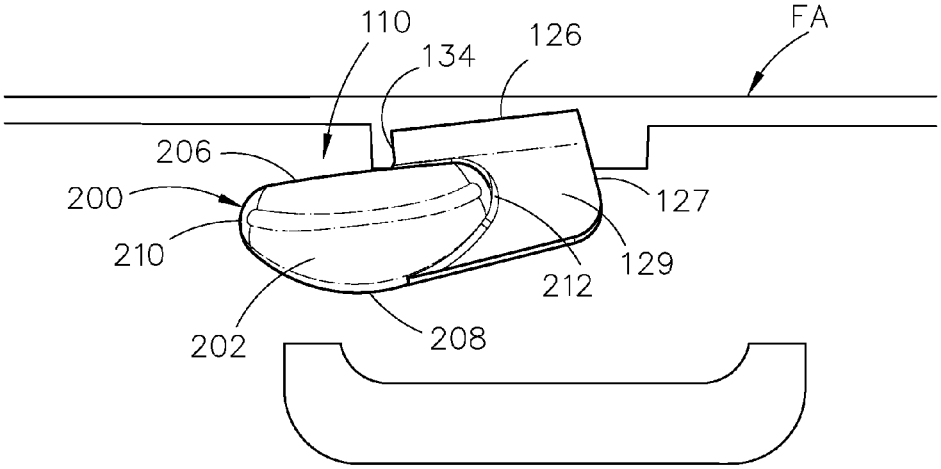
FIG. 12 is an enlarged view of the present invention mounted within the firearm.
Figure 13:
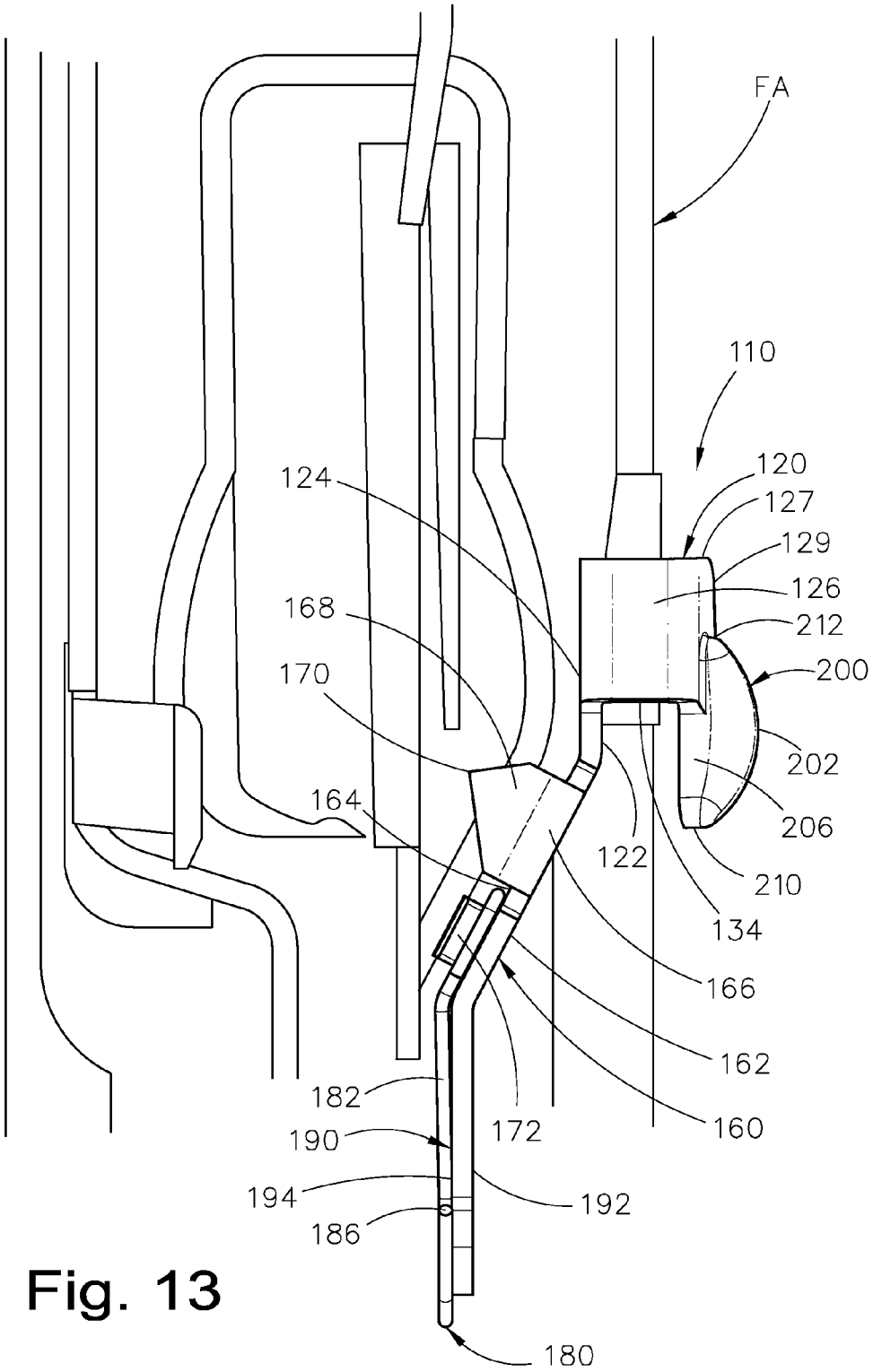
FIG. 13 is an enlarged top view of the instant invention mounted within the firearm.

As best seen in FIGS. 12 and 13, thumb tab 200 comprises thumb tab exterior face 202, thumb tab interior face 204, top edge 206, bottom edge 208, forward edge 210 and rear edge 212.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firearm slide stop having a forward facing thumb tab, comprising:

A) a slide stop thumb tab frame section comprising a slide engagement edge on a first plane, and a first forward edge, said first forward edge is a first predetermined distance from said first plane of said slide engagement edge, said slide stop thumb tab frame section further comprises a top face that extends to a slide engagement exterior wall having a slide engagement bottom edge, extending from said slide engagement exterior wall is a thumb tab, said thumb tab comprises a thumb tab exterior face and a thumb tab interior face, top and bottom edges, a second forward edge, and a rear edge, said thumb tab protrudes outwardly from said slide engagement exterior wall, said second forward edge is a second predetermined distance from said first plane of said slide engagement edge, whereby said second predetermined distance is greater than said first predetermined distance, and said first forward edge is on a different plane than said second forward edge;

B) a slide stop intermediate frame section;

C) a slide stop forward frame section, said thumb tab extends a third predetermined distance beyond said first forward edge towards said slide stop forward frame section without reaching said slide stop forward frame section, a fourth predetermined distance between said top and bottom edges is lesser than a fifth predetermined distance between said second forward edge and said rear edge, whereby said first forward edge is positioned between said second forward edge and said rear edge, and said rear edge is positioned between said slide engagement edge and said first forward edge on said slide engagement exterior wall permitting said thumb tab to remain unobstructed to give visual indication when a firearm has expended all loaded ammunition when in fact it has; and D) a spring mounted onto said slide stop intermediate frame section.

2. The firearm slide stop having a forward facing thumb tab set forth in claim 1, further characterized in that said slide stop intermediate frame section further comprises first interior and exterior faces, and a magazine follower actuator having a top wall with an end, said slide stop intermediate frame section further comprises a spring clamp.

3. The firearm slide stop having a forward facing thumb tab set forth in claim 2, further characterized in that said slide stop forward frame section comprises second interior and exterior faces and a through hole.

4. The firearm slide stop having a forward facing thumb tab set forth in claim 3, further characterized in that said spring comprises a body having first and second ends.

5. The firearm slide stop having a forward facing thumb tab set forth in claim 4, further characterized in that said said thumb tab facilitates re-loading by removing a step of pulling back a slide of said firearm to advance a first round of a new magazine when replacing an empty magazine and activating a push-button or lever release to load a first cartridge into a chamber.

* * * * *